US011007572B2

(12) United States Patent
Ito et al.

(10) Patent No.: US 11,007,572 B2
(45) Date of Patent: May 18, 2021

(54) SLIDING MEMBER AND METHOD FOR PRODUCING SAME

(71) Applicant: NTN CORPORATION, Osaka (JP)

(72) Inventors: Yoshinori Ito, Ama-gun (JP); Hajime Asada, Ama-gun (JP); Hiroshi Akai, Kuwana (JP); Kei Hattori, Kuwana (JP)

(73) Assignee: NTN CORPORATION, Osaka (JP)

( * ) Notice: Subject to any disclaimer, the term of this patent is extended or adjusted under 35 U.S.C. 154(b) by 242 days.

(21) Appl. No.: 15/753,205

(22) PCT Filed: Jul. 19, 2016

(86) PCT No.: PCT/JP2016/071108
§ 371 (c)(1),
(2) Date: Feb. 16, 2018

(87) PCT Pub. No.: WO2017/029921
PCT Pub. Date: Feb. 23, 2017

(65) Prior Publication Data

US 2018/0236553 A1 Aug. 23, 2018

(30) Foreign Application Priority Data

Aug. 17, 2015 (JP) ..... JP2015-160410
Mar. 30, 2016 (JP) ..... JP2016-069125

(51) Int. Cl.
*B22F 3/24* (2006.01)
*C22C 33/02* (2006.01)
(Continued)

(52) U.S. Cl.
CPC ..... *B22F 3/24* (2013.01); *B22F 5/00* (2013.01); *C21D 1/06* (2013.01); *C21D 1/46* (2013.01);
(Continued)

(58) Field of Classification Search
None
See application file for complete search history.

(56) References Cited

U.S. PATENT DOCUMENTS 4,655,853 A 4/1987 Byrnes et al.
6,089,843 A * 7/2000 Kondoh ..... B22F 7/08 251/368
(Continued)

FOREIGN PATENT DOCUMENTS

EP 1 602 743 12/2005
JP 59-133301 7/1984
(Continued)

OTHER PUBLICATIONS

English translation of JP2004-269973, from EPO, printed Jan. 18, 2020 (3 pages). (Year: 2020).*
(Continued)

*Primary Examiner* — Adam Krupicka
(74) *Attorney, Agent, or Firm* — Wenderoth, Lind & Ponack, L.L.P.

(57) ABSTRACT

A sliding member (1) includes an iron and steel-based sintered compact containing chromium, molybdenum, and carbon and having a content of chromium, of 5 mass % or less. The sliding member (1) includes: a compound layer (11) which has a sliding surface (1*a*) and is formed mainly of an iron and steel nitride; and a diffusion layer (12) which is adjacent to the compound layer (11) and has an iron and steel structure into which nitrogen and carbon diffuse. The concentrations of carbon and nitrogen in the diffusion layer (12) are gradually reduced with increasing depth from the sliding surface (1*a*).

7 Claims, 4 Drawing Sheets

(51) Int. Cl.

| | |
|---|---|
| ***C21D 1/06*** | (2006.01) |
| ***C23C 8/22*** | (2006.01) |
| ***C22C 38/22*** | (2006.01) |
| ***C22C 38/00*** | (2006.01) |
| ***C21D 1/46*** | (2006.01) |
| ***C22C 38/50*** | (2006.01) |
| ***C23C 8/02*** | (2006.01) |
| ***C23C 8/56*** | (2006.01) |
| ***C23C 28/04*** | (2006.01) |
| ***C23C 8/32*** | (2006.01) |
| ***C23C 8/80*** | (2006.01) |
| ***C23C 8/26*** | (2006.01) |
| ***C23C 8/34*** | (2006.01) |
| ***B22F 5/00*** | (2006.01) |
| ***C23C 8/50*** | (2006.01) |
| *B22F 5/10* | (2006.01) |

(52) U.S. Cl.

CPC ..... *C22C 33/02* (2013.01); *C22C 38/00* (2013.01); *C22C 38/22* (2013.01); *C22C 38/50* (2013.01); *C23C 8/02* (2013.01); *C23C 8/22* (2013.01); *C23C 8/26* (2013.01); *C23C 8/32* (2013.01); *C23C 8/34* (2013.01); *C23C 8/50* (2013.01); *C23C 8/56* (2013.01); *C23C 8/80* (2013.01); *C23C 28/04* (2013.01); *B22F 5/10* (2013.01); *B22F 2003/242* (2013.01); *B22F 2301/35* (2013.01); *B22F 2998/10* (2013.01)

(56) References Cited

U.S. PATENT DOCUMENTS

| | | | | |
|---|---|---|---|---|
| 6,294,029 | B1 | 9/2001 | Sakate et al. | |
| 7,108,829 | B2 * | 9/2006 | Fukuhara | B22F 3/225 419/29 |
| 2004/0179968 | A1 | 9/2004 | Fukuhara et al. | |
| 2006/0207540 | A1 * | 9/2006 | Matsui | C23C 14/028 123/90.49 |

FOREIGN PATENT DOCUMENTS

| | | |
|---|---|---|
| JP | 3-74506 | 3/1991 |
| JP | 6-307471 | 11/1994 |
| JP | 2000-303161 | 10/2000 |
| JP | 2000-355726 | 12/2000 |
| JP | 2001-342554 | 12/2001 |
| JP | 2004-269973 | 9/2004 |
| JP | 2005-226654 | 8/2005 |
| WO | 2004/081252 | 9/2004 |

OTHER PUBLICATIONS thelibraryofmanufacturing.com, captured Dec. 10, 2013 https://web.archive.org/web/20131210231811/https://thelibrayofmanufacturing.com/pressing_sintering.html (7 pages) (Year: 2020).*

International Preliminary Report on Patentability dated Feb. 20, 2018 in International Application No. PCT/JP2016/071108.

International Search Report (ISR) dated Aug. 16, 2016 in International (PCT) Application No. PCT/JP2016/071108.

Notice of Reasons for Refusal dated Jun. 17, 2020 in corresponding Japanese Patent Application No. 2016-157399 with English-language translation.

* cited by examiner

SLIDING MEMBER AND METHOD FOR PRODUCING SAME

TECHNICAL FIELD

The present invention relates to a sliding member including an iron and steel-based sintered compact and a production method for the same.

BACKGROUND ART

For example, in Patent Literature 1, there is a description of a swash plate-type air compressor as illustrated in FIG. 6. The swash plate-type air compressor includes a rotary shaft 102 with a swash plate which includes a swash plate 103 inclined with respect to a shaft core at a predetermined angle. Pistons 104 are assembled in parallel to one another in a periphery of the swash plate 103 at a plurality of positions (e.g., at 5 positions) which are circumferentially equally spaced apart from one another. The rotary shaft 102 is inserted into shaft holes 105*a* and 106*a* of substantially cylindrical cylinders 105 and 106. Each piston 104 is housed in bosses 105*b* and 106*b* of the cylinders 105 and 106 so as to be slidable in an axial direction.

A notch configured to hold the periphery of the swash plate 103 is formed in the middle of a body portion of each piston 104. Further, a pair of shoes 107 configured to sandwich the swash plate 103 in the axial direction are arranged in each notch. The shoes 107 are formed to reduce friction with the swash plate 103, and each have a spherical surface brought into contact with a wall surface of the notch of each piston 104 and a flat surface brought into surface contact with a front or back surface of the swash plate 103.

When the rotary shaft 102 having the above-mentioned configuration is rotated, each piston 104 moves in any one of the axial direction by a pressing force from the rotating swash plate 103. With this, the pistons 104 reciprocate in the axial direction at a certain phase angle, and thus compressed air is continuously discharged.

CITATION LIST

Patent Literature 1: JP 2005-226654 A

SUMMARY OF INVENTION

Technical Problem

When the swash plate-type air compressor is driven as described above, an end surface of the swash plate 103 and the flat surface of each shoe 107 slide with respect to each other at high speed while being pressed against each other, and there is a risk in that abnormal wear (in particular, adhesive wear) occurs. Accordingly, the swash plate 103 and the shoes 107 each need to be formed of a material excellent in wear resistance.

Meanwhile, in some cases, the swash plate 103 and the shoes 107 as described above are each formed of a sintered metal (sintered compact) for the purpose of, for example, improving friction and wear characteristics and reducing a production cost. When a member configured to slide at an ultra-high PV value (at high speed and high contact pressure) is formed of a sintered compact as just described, the sintered compact needs to be increased in wear resistance against adhesive wear. For this, it is important to increase the density, strength (sintering neck strength), and surface hardness of the sintered compact.

However, when powder having a high hardness (e.g., stainless steel powder), which has a difficulty in deforming, is used in order to increase the surface hardness of the sintered compact, the density of a green compact, and by extension, the density of the sintered compact cannot be increased sufficiently, which may lead to lack of strength. Meanwhile, when powder having a low hardness (e.g., low-chromium steel powder) is used in order to increase the density and strength of the sintered compact, lack of the surface hardness of the sintered compact may occur. FIG. 7 is a graph for showing relationships between: the content of chromium in steel powder serving as a main component of raw material powder for a sintered compact; and the density ($g/cm^3$) and hardness (Hv 0.1) of the sintered compact. From the graph, it is found that, as the content of chromium becomes higher (i.e., the steel powder becomes harder), the sintered compact becomes harder, but has a lower density. As described above, it is not easy to increase all of the density, strength, and surface hardness of the sintered compact.

For example, when low-chromium steel powder, which is relatively soft, is used to form a sintered compact having a high density, and the sintered compact is then subjected to surface hardening treatment, a sintered compact having a high density, high strength, and a high hardness is obtained. A possible specific surface hardening treatment method for the sintered compact is carburizing and quenching treatment. However, the surface hardness of the sintered compact having been subjected to the carbonizing and quenching treatment remains at about 700 HV, and further increases in hardness and strength may be required in the case of sliding at an ultra-high PV value.

Another surface hardening treatment method for the sintered compact is nitriding treatment (e.g., gas nitrocarburizing treatment). When the sintered compact is subjected to the nitriding treatment, in a surface layer of the sintered compact, a compound layer having a high hardness is formed, and a diffusion layer having an iron and steel structure into which nitrogen diffuses is formed under the compound layer. In this case, as the amount of chromium contained in steel powder serving as a raw material becomes large, penetration and diffusion of nitrogen into the iron and steel (including alloy steel) structure are promoted more, and the hardness of the surface layer of the sintered compact is increased more. However, when the low-chromium steel powder, which has a small amount of chromium, is used in order to increase the density of the sintered compact, penetration and diffusion of nitrogen into the iron and steel structure become insufficient, and the hardness of the surface layer of the sintered compact cannot be increased sufficiently. Therefore, through gas nitrocarburizing treatment, the surface hardness of the sintered compact which is formed through use of the low-chromium steel powder and has a high density can only be increased up to from about 700 HV to about 800 HV.

Still another surface hardening treatment method for the sintered compact is carbonitriding treatment. The carbonitriding treatment is a heat treatment method involving adding nitrogen (e.g., an ammonia gas) to an atmosphere in which carburizing treatment is performed to allow carbon and nitrogen to penetrate and diffuse into the surface layer of the sintered compact at the same time. However, the carbonitriding treatment is performed under conditions (an atmosphere gas, a temperature, and the like) for mainly allowing carbon to penetrate and diffuse into the surface layer of the sintered compact, and hence the amount of nitrogen to penetrate and diffuse thereinto is extremely small, and the compound layer is not formed in the surface layer. As a result, even when the sintered compact is subjected to the carbonitriding treatment, the sintered compact cannot be said to have a sufficient hardness and sufficient strength at an ultra-high FV value.

Under the above-mentioned circumstances, an object of the present invention is to increase wear resistance of a sliding member including an iron and steel-based sintered compact and prevent abnormal wear at an ultra-high PV value.

Solution to Problem

In order to achieve the above-mentioned object, according to one embodiment of the present invention, there is provided a production method for a sliding member, comprising the steps of: forming a green compact through use of raw material powder containing chromium-molybdenum-based alloy steel powder having a content of chromium of 5 mass % or less and carbon powder; sintering the green compact to provide a sintered compact; subjecting the sintered compact to carburizing treatment to allow carbon to penetrate and diffuse into a surface layer of the sintered compact, followed by subjecting the sintered compact to quenching; and subjecting the sintered compact to nitriding treatment to allow nitrogen to penetrate and diffuse into the surface layer of the sintered compact, in the stated order.

As described above, in the present invention, the content of chromium in the chromium-molybdenum-based alloy steel powder contained in the raw material powder is reduced to reduce the hardness of the steel powder. Thus the density or the green compact, and by extension, the density of the sintered compact can be increased. Specifically, the content of chromium in the chromium-molybdenum-based alloy steel powder (≈the content of chromium in the sintered compact) is 5 mass % or less. When such steel powder having a low hardness is used, the surface hardness of the sintered compact is reduced, and hence the sintered compact needs to be subjected to surface hardening treatment. As surface hardening treatment on the sintered compact, it has hitherto been general to perform any one of carburizing and quenching treatment and nitriding treatment, or to perform carbonitriding treatment in which carburizing treatment and nitriding treatment are performed at the same time. However, the present invent ion includes subjecting the sintered compact to carburizing and quenching treatment, and then subjecting the sintered compact to nitriding treatment in another step. Specifically, when the sintered compact is subjected to the carburizing and quenching treatment, carbon sufficiently penetrates and diffuses into the surface layer of the sintered compact to achieve increases in strength and hardness. After that, when the sintered compact is subjected to the nitriding treatment, a compound layer and a diffusion layer are formed in the surface layer of the sintered compact. Thus, the compound layer having an ultra-high hardness is formed on a surface (sliding surface) of the sintered compact, and the diffusion layer having high strength into which carbon has sufficiently penetrated and diffused through the preliminary carburizing treatment, and then nitrogen penetrates and diffuses through the nitriding treatment is formed under the compound layer. As described above, the density, strength, and hardness of the sintered compact can be increased sufficiently.

It is preferred that the nitriding treatment include salt-bath nitrocarburizing treatment.

In some cases, the sliding surface of the sintered compact is subjected to grinding work because high dimensional accuracy is required for the sliding surface. For example, when the sintered compact is subjected to grinding work after the nitriding treatment, there is a risk in that the compound layer having a high hardness is removed. Accordingly, it is preferred that the production method according to the embodiment of the present invention further include, before the subjecting the sintered compact to nitriding treatment, subjecting the sintered compact to grinding work to form a sliding surface.

According to the production method according to the embodiment of the present invention, carbon and nitrogen penetrate and diffuse from the surface of the sintered compact, and hence the concentrations of carbon and nitrogen in the surface layer (in particular, the diffusion layer) of the sintered compact are gradually reduced with increasing depth from the surface. That is, a sliding member produced by the production method has a negative concentration gradient in a depth direction. Accordingly, according to one embodiment of the present invention, there can be provided a sliding member having the following feature: a sliding member, comprising an iron and steel-based sintered compact containing chromium, molybdenum, and carbon and having a content of chromium of 5 mass % or less, wherein the sintered compact comprises: a compound layer which has a sliding surface and is formed mainly of an iron and steel nitride; and a diffusion layer which is adjacent to the compound layer and has an iron and steel structure into which nitrogen and carbon diffuse, and wherein concentrations of carbon and nitrogen in the diffusion layer of the sintered compact are gradually reduced with increasing depth from the sliding surface.

In the sliding member according to the embodiment of the present invention, the concentration of carbon in the diffusion layer is sufficiently high. Specifically, for example, the concentration of carbon at an interface between the compound layer and the diffusion layer is 0.6 mass % or more.

The sintered compact has a relative: density (a ratio of a density to a true density) of 90% or more, preferably 92% or more, more preferably 93% or more. When the density of the sintered compact is increased as just described, strength and wear resistance are increased. In addition, in the case in which the sintered compact is subjected to salt-bath nitrocarburizing, a treatment liquid is liable to penetrate into inner pores of the sintered compact when the sintered compact has a low density (i.e., a high porosity), resulting in the necessity of discharging the treatment liquid from the inner pores after the treatment. However, it is difficult to completely discharge the treatment liquid having penetrated into the sintered compact. In view of the foregoing, the density of the sintered compact is increased as described above, and hence the treatment liquid hardly penetrates into the inner pores of the sintered compact, with the result that a situation in which the treatment liquid remains in the sintered compact can be avoided.

Incidentally, when the sintered compact is subjected to any one of carburizing treatment and nitriding treatment, the hardness of the sintered compact is gradually reduced with increasing depth from the surface (see the dashed line and the dotted line of FIG. 4). Specifically, the hardness is highest on the surface, and is drastically reduced with increasing depth from the surface along with a reduction in concentration of carbon or nitrogen. At a greater depth, a hardness change rate (gradient) slows down. In contrast, when the sintered compact is subjected to carburizing treatment, followed by being subjected to nitriding treatment as in the present invention, a substantially fiat region F in which the hardness remains high (a region having a lower gradient than regions on both sides thereof in a depth direction) is formed in the diffusion layer of the sintered compact (see the solid line of FIG. 4).

Accordingly, according to one embodiment of the present invention, there can be provided a sliding member having the following feature: a sliding member, comprising an iron and steel-based sintered compact containing chromium, molybdenum, and carbon and having a content of chromium of 5 mass % or less, wherein the sintered compact comprises: a compound layer which has a sliding surface and is formed mainly of an iron and steel nitride; and a diffusion layer which is adjacent to the compound layer and has an iron and steel structure into which nitrogen and carbon diffuse, wherein a hardness of the sintered compact is gradually reduced with increasing depth from the sliding surface, and wherein a curve representing the hardness of the sintered compact as a function of a depth from the sliding surface has, in a region in a depth direction of the diffusion layer, a region having a lower gradient than regions on both sides thereof in the depth direction.

Advantageous Effects of Invention

As described above, according to the present invention, the density, strength, and hardness of the sliding member including the iron and steel-based sintered compact can be increased, and hence the wear resistance of the sliding member can be increased. Thus, abnormal wear at an ultra-high PV value can be prevented.

DESCRIPTION OF EMBODIMENTS

Now, an embodiment of the present invent ion is described with reference to the drawings.

Figure 1:
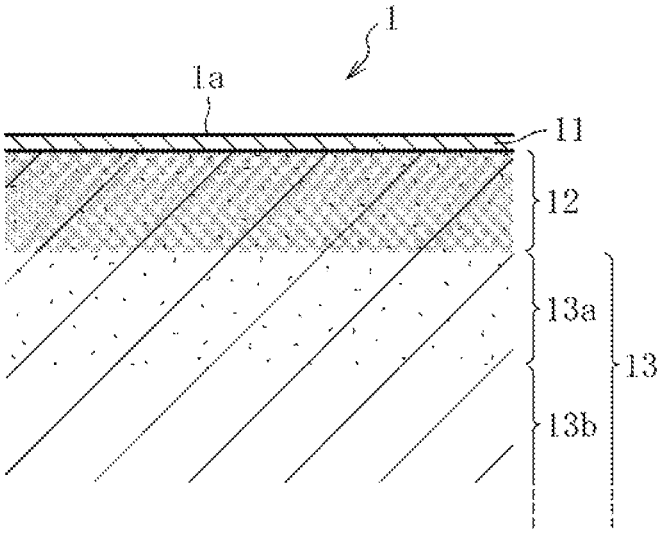
FIG. 1 is a sectional view of a surface layer of a sliding member according to an embodiment of the present invention.
Figure 6:
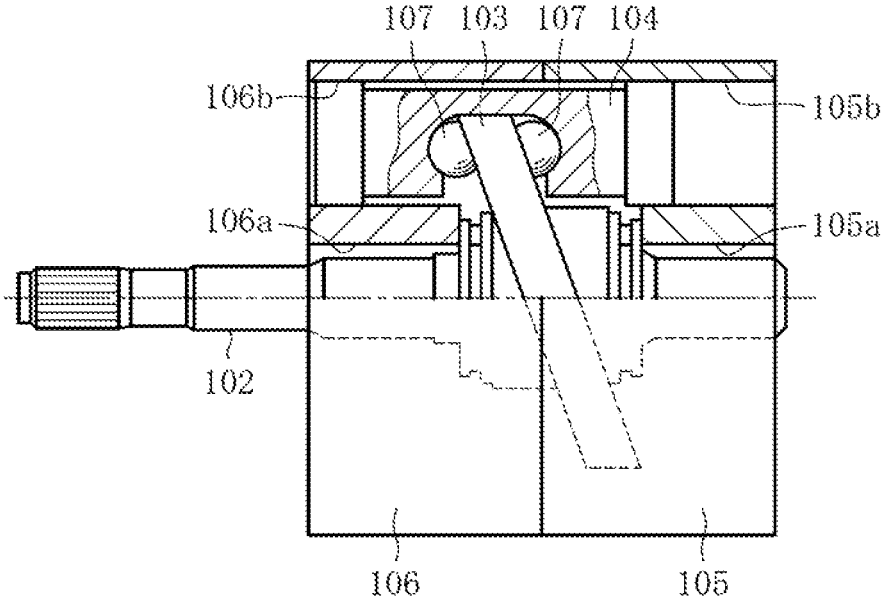
FIG. 6 is a sectional view of a swash plate-type air compressor.
Figure 7:
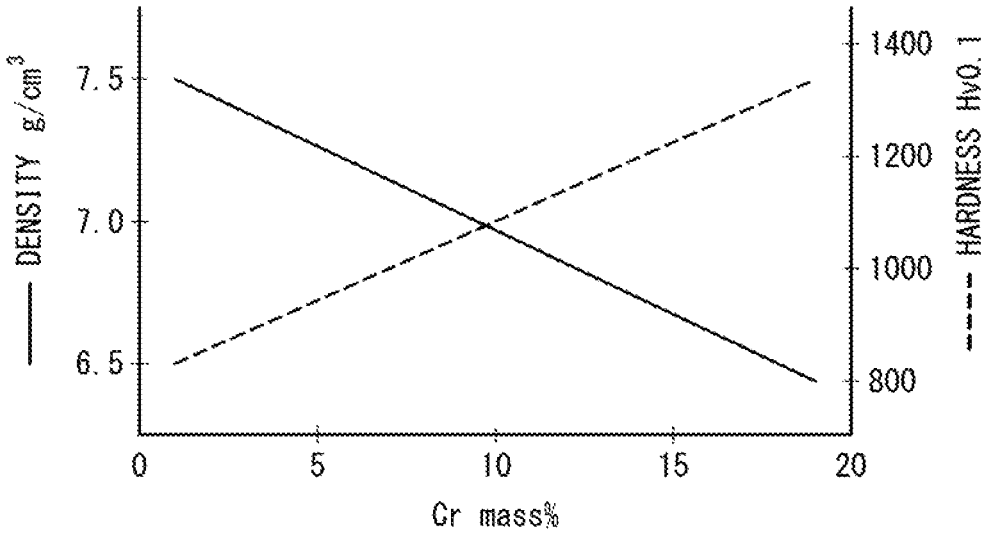
FIG. 7 is a graph for showing relationships between: the content of chromium in steel powder; and the density and hardness of a sintered compact.

FIG. 1 is an enlarged sectional view of a sliding member 1 according to an embodiment of the present invention. The sliding member 1 is used, for example, as the swash plate 103 of the swash plate-type air compressor illustrated in FIG. 6. A sliding surface 1*a* configured to slide with respect to the shoes 107 is formed at a periphery of both end surfaces and a back surface of the sliding member 1.

The sliding member 1 is formed of a sintered compact, specifically, an iron-based sintered compact containing iron as a main component. The blending ratio of iron in the sintered compact is 80 mass % or more, preferably 90 mass % or more, still more preferably 95 mass % or more.

The sintered compact mainly has an iron and steel structure containing chromium, molybdenum, and carbon. The ratios of the components in the sintered compact are, for example, as follows: the content of carbon is from 0.01 mass % to 1 mass %, the content of chromium is from 0.05 mass % to 5 mass %, and the content of molybdenum is from 0.1 mass % to 3 mass % (preferably front 0.1 mass % to 1 mass %), with the balance being iron. In particular, the content of chromium in the sintered compact is preferably 4 mass % or less, more preferably 3 mass % or less. One kind or a plurality of kinds selected from silicon, manganese, aluminum, phosphorus, copper, silicon, and the like may be blended in addition to the above-mentioned components. In particular, aluminum and silicon each serve to promote diffusion of nitrogen into the iron and steel structure in nitriding treatment described below.

The sintered compact has a relative density with respect to a true density of 90% or more, preferably 92% or more, more preferably 93% or more. That is, the sintered compact has a porosity of 10% or less, preferably 8% or less, more preferably 7% or less. The sintered compact has an average pore diameter of, for example, 20 μm or less. The sintered compact having a composition of this embodiment has a density of 7.0 g/cm$^3$ or more, preferably 7.2 g/cm$^3$ or more, more preferably 7.3 g/cm$^3$ or more. In addition, in view of limits of an output, a withstand load, and the like of a production facility, the sintered compact has a relative density of, for example, 98% or less (or a density of 7.8 g/cm$^3$ or less).

As illustrated in FIG. 1, a compound layer 11, a diffusion layer 12, and a base material layer 13 are formed in the sliding member 1 in the stated order from a surface.

The compound layer 11 is a layer formed of an iron and steel nitride. Specifically, the compound layer 11 is formed mainly of and $Fe_2N$ and $Fe_3N$. The compound layer 11 contains chromium, molybdenum, and carbon. The sliding surface 1*a* is formed in the compound, layer 11. The compound layer 11 has a high hardness and has a smooth surface, and hence the sliding surface 1*a*, which is formed in the compound layer 11, is excellent in slidability with respect to a mating member. The thickness of the compound layer 11 is, for example, 5 μm or more, preferably 10 μm or more. Meanwhile, the thickness of the compound layer 11 is, for example, 40 μm or less (preferably 20 μm or less) because the compound layer 11 is fragile and has a risk of being broken when having an excessively large thickness.

Figure 2:
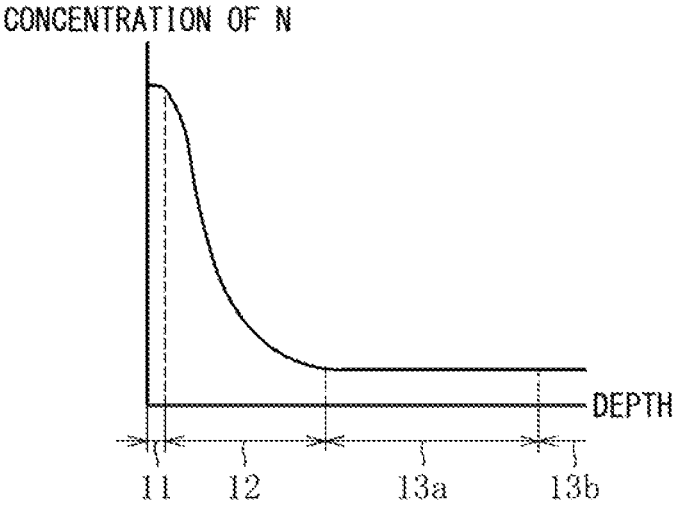
FIG. 2 is a graph for showing a nitrogen concentration distribution in the surface layer of the sliding member.
Figure 3:
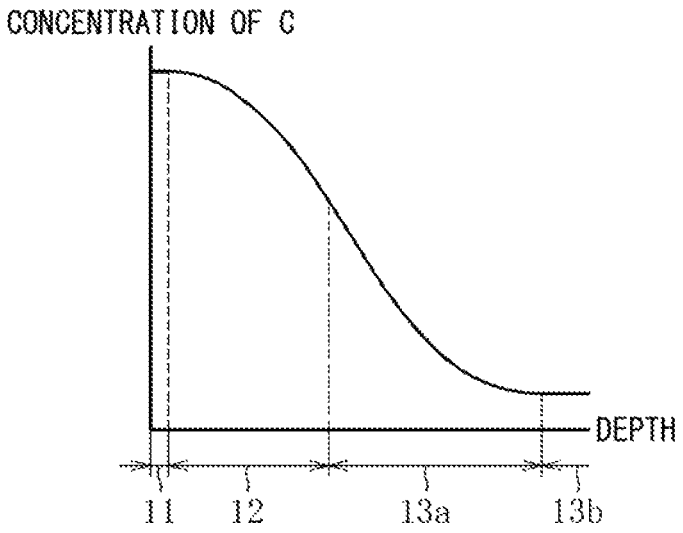
FIG. 3 is a graph for showing a carbon concentration distribution in the surface layer of the sliding member.

The diffusion layer 12 has an iron and steel structure into which nitrogen and carbon diffuse. The diffusion layer 12 is formed so as to be adjacent to an inner side of the compound layer 11. Nitrogen in the diffusion layer 12 is derived from nitriding treatment described below by penetrating and diffusing thereinto from the surface (including pores), and the concentration of nitrogen is reduced with increasing depth (see FIG. 2). In addition, carbon in the diffusion layer 12 is derived from raw material powder and from carburizing treatment described below by penetrating and diffusing thereinto from the surface (including pores), and the concentration of carbon is reduced with increasing depth (see FIG. 3). The concentration of carbon at an interface between the di f fusion layer 12 and the compound layer 11 is 0.6 mass % or more, preferably 0.7 mass % or more, more preferably 0.8 mass % or more. In addition, the concentration of carbon at the interface between the diffusion layer 12 and the compound layer 11 is 1.2 mass % or less, preferably 1.0 mass % or less. In this embodiment, the concentration of carbon at the interface between the diffusion layer 12 and the compound layer 11 is 0.8 mass %. The thickness of the diffusion layer 12 is larger than that of the compound layer 11, and is, for example, 20 μm or more, 40 μm or more, or 50 μm or more. In addition, the thickness of the diffusion layer 12 is 300 μm or less or 200 μm or less. As the concentration of carbon in the sliding member 1, for example, images of the sliding member 1 are taken with an electron microscope oft a plurality of points in a cross section, and an average value of concentrations of carbon obtained through analysis of the taken images may be used.

The base material layer 13 has an iron and steel structure into which carbon diffuses, specifically has a structure mainly formed of a bainite structure. Carbon in the base material layer 13 is derived from raw material powder for the sintered compact and from carburizing treatment described below by penetrating and diffusing thereinto from the surface (including pores). Specifically, the base material layer 13 includes a gradient region 13*a* in which the concentration of carbon is reduced with increasing depth and a constant region 13*b* in which the concentration of carbon is substantially constant in a depth direction (see FIG. 3). The concentration of carbon in the base material layer 13 is, for example, 0.5 mass % or less, preferably 0.4 mass % or less, more preferably 0.35 mass % or less. In addition, the concentration of carbon in the base material layer 13 is, for example, 0.1 mass % or more, preferably 0.2 mass % or more. The base material layer 13 contains nitrogen in a slight amount. The concentration of nitrogen in the base material layer 13 is substantially constant in the depth direction without a concentration gradient (see FIG. 2).

Figure 4:
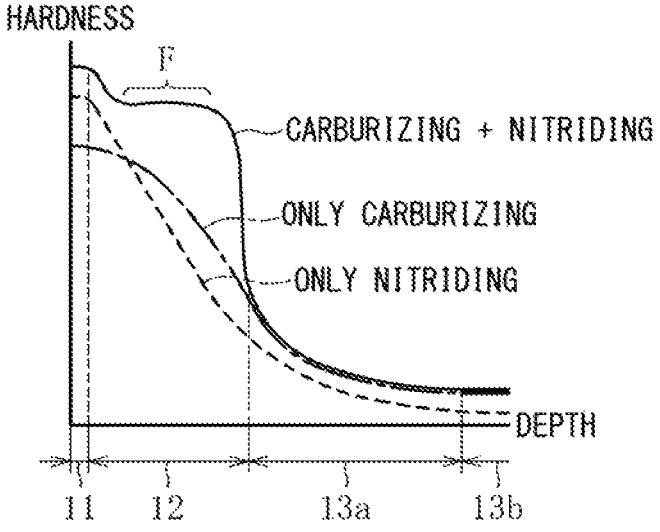
FIG. 4 is a graph for showing a hardness distribution in the surface layer of the sliding member.

A distribution of the hardness of the sliding member 1 in the depth direction is shown in FIG. 4. As shown in FIG. 4, the hardness of the sliding member 1 is reduced with increasing depth. In this embodiment, the hardness of the compound layer 11 (a hardness on the sliding surface 1*a*) is from 850 HV to 1,000 HV, the hardness of the diffusion layer 12 (a hardness at an interface with the compound layer 11) is from 700 HV to 800 HV, and the hardness of the base material layer 13 (a hardness at an interface with the diffusion layer 12) is from 400 HV to 600 HV.

Incidentally, when the sintered compact is subjected only to carburizing and quenching treatment, the hardness is reduced with increasing depth from the surface as shown by the dashed line of FIG. 4. Meanwhile, when the sintered compact is subjected only to nitriding treatment (salt-bath nitrocarburizing treatment), the hardness is extremely high on the surface through the formation of the compound layer, and is reduced with increasing depth from the surface, as shown by the dotted line of FIG. 4. In each case, the hardness is highest on the surface, and is drastically reduced with increasing depth from the surface along with a reduction in concentration of carbon or nitrogen. At a greater depth, a hardness change rate (gradient) slows down.

In contrast, the sliding member 1 of this embodiment is obtained by subjecting the sintered compact to carburizing and quenching treatment, followed by nitriding treatment. Its hardness curve is shown by the solid line of FIG. 4. In the hardness curve, the hardness is gradually reduced with increasing depth from the surface as in the case in which anyone of the carburizing and quenching treatment and the nitriding treatment is performed (see the dashed line and the dotted line of FIG. 4), but the curve includes a substantially flat region F in which the hardness remains high in the diffusion layer 12. Specifically, in the hardness curve of the sliding member 1 in the depth direction, the substantially flat region F has a gradient of substantially zero, whereas regions adjacent to both sides of the substantially flat region F in the depth direction each have a higher gradient than the substantially flat region F (i.e., a large absolute value of the gradient). As described above, the hardness of the sliding member 1 of this embodiment is higher than one obtained by performing any one of the carburizing and quenching treatment and the nitriding treatment, not only on the surface (sliding surface) but also in the diffusion layer. In addition, carbon and nitrogen sufficiently diffuse into the diffusion layer, and hence the diffusion layer has higher strength than in the one obtained by performing any one of the carburizing and quenching treatment and the nitriding treatment.

The compound layer 11 has an extremely high hardness, and hence, when the sliding surface 1*a* of the sliding member 1 is formed in the compound layer 11, wear resistance on the sliding surface 1*a* can be increased. However, when a con tact pressure applied onto the sliding surface 1*a* is excessively high, there is a risk in that the diffusion layer 12 configured to support the compound layer 11 cannot bear the high contact pressure and is crushed even when the compound layer 11 is formed to increase the hardness on the sliding surface. In view of the foregoing, as described above, the diffusion layer 12 having a high hardness and high strength is formed under the compound layer 11 in addition to forming the compound layer 11, and hence the sliding surface 1*a* excellent in slidability and capable of withstanding a high contact pressure can be obtained.

As described above, according to the present invention, the density of the sintered compact constituting the sliding member 1 is increased, and thus the sliding surface 1*a* is formed in the compound layer 11 having a high hardness. Further, the hardness and strength of the diffusion layer 12 configured to support the compound layer 11 can be increased. As a result, the wear resistance of the sliding member 1 is increased. With this, abnormal wear can be prevented even under a use condition of the sliding member 1 of an ultra-high PV value (e.g., 2,000 MPa·m/min or more and 10,000 MPa·m/min or less).

Next, a production method for the sliding member 1 having the above-mentioned configuration is described. The sliding member 1 is produced through (1) a compacting step, (2) a sintering step, (3) a carburizing and quenching step, (4) a grinding step, and (5) a nitriding step. The steps are described in detail below.

(1) Compacting Step

Various powders are mixed to produce raw material powder, and the raw material powder is packed in a forming mold and subjected to compression molding. Thus, a green compact is formed. In this embodiment, chromium-molybdenum-based alloy steel powder (e.g., iron-chromium-molybdenum completely alloyed steel powder (pre-alloyed powder)) and carbon powder (e.g., graphite powder) are mixed to produce the raw material powder. Various molding lubricants (e.g., a lubricant for improving mold releasability) may be added to the raw material powder as required. The blending ratios of the components in the raw material powder are, for example, as follows: the blending amount, of carbon is from 0.01 mass % to 1 mass %, the blending amount of chromium is from 0.5 mass % to 5 mass %, and the blending amount of molybdenum is from 0.1 mass % to 3 mass %, with the balance being Fe. In this embodiment, the chromium-molybdenum-based alloy steel powder is low-chromium steel powder in which the blending amount of chromium is 5 mass % or less, preferably 4 mass % or less, more preferably 3 mass % or less. With this, the hardness of the steel powder, which constitutes a large part of the raw material powder, is reduced, and hence the powder easily deforms through the compression molding, with the result that the density of the green compact is increased.

When the low-chromium steel powder has an excessively small particle diameter, mixed powder cannot be uniformly packed into a cavity owing to insufficient fluidity of the mixed powder, and there is a risk in that the density of the green compact is not increased sufficiently. In addition, when the low-chromium steel powder has an excessively large particle diameter, a gap between particles becomes excessively large, and there is also a risk in that the density of the green compact is not increased sufficiently. Accordingly, the average particle diameter of the low-chromium steel powder is, for example, 40 μm or more and 150 μm or less, preferably 63 μm or more and 106 μm or less.

Through the subsequent sintering step, the graphite powder in the green compact is solid solved in an iron and steel structure, and the molding lubricant in the green compact disappears. Thus, spaces in which the graphite powder and the molding lubricant exist become pores in the sintered compact. Therefore, it is desired that the blending ratios of the graphite powder and the molding lubricant be reduced to the extent possible in order to increase the density of the sintered compact to the extent possible. Specifically, it is desired that the blending ratio of the graphite powder in the raw material powder be 0.5 mass % or less, preferably 0.4 mass % or less, more preferably 0.35 mass % or less, and is from 0.2 mass % to 0.3 mass % in this embodiment. In addition, the blending ratio of the molding lubricant in the raw material powder is desirably 0.6 mass % or less, and is from 0.25 mass % to 0.55 mass % in this embodiment.

(2) Sintering Step

The green compact is sintered in an inert gas atmosphere to provide a sintered compact. A sintering temperature is, for example, 1,100° C. or more, preferably 1,200° C. or more. With this, the chromium-molybdenum-based alloy steel powders are sintered to be bonded to each other to form the iron and steel structure, and the graphite powder in the green compact diffuses into the iron and steel structure to increase strength.

(3) Carburizing and Quenching Step

Figure 5:
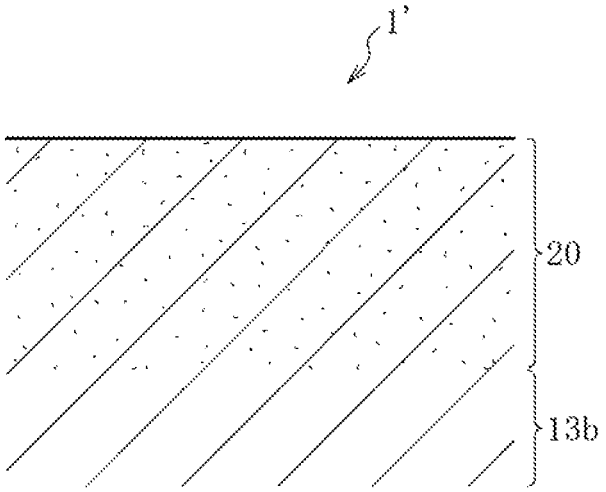
FIG. 5 is a sectional view of a surface layer of a sintered compact having been subjected to carburizing treatment serving as a precursor of the sliding member.

The sintered compact is subjected to carburizing treatment, and is then cooled (subjected to quenching), followed by being subjected to tempering treatment. The carburizing treatment to be performed is, for example, gas carburizing. Specifically, the sintered compact is heated to, for example, from about 800° C. to 1,000° C. in an atmosphere containing carbon and retained for a predetermined time (e.g., for from 100 minutes to 200 minutes) to allow carbon to penetrate and diffuse into a surface layer of the sintered compact. With this, as illustrated in FIG. 5, a carbon diffusion layer 20 having a higher concentration of carbon than an inside is formed in a surface layer of a sintered compact 1'. The carbon potential of the carburizing treatment is, for example, from 0.7 mass % to 1.2 mass %, preferably from 0.8 mass % to 1.0 mass %. The concentration of carbon on a surface of the carbon diffusion layer 20 is 0.6 mass % or more, preferably 0.7 mass % or more, more preferably 0.8 mass % or more, and is reduced with increasing depth from the surface. Under the carbon diffusion layer 20 (on an inner side), the constant region 13*b* of the base material layer 13 into which carbon in the atmosphere hardly penetrates and diffuses and which has almost the same composition as the sintered compact before carburizing is formed. The sintered compact 1' thus heated is subjected to quenching treatment by being cooled. With this, an iron and steel structure formed mainly of martensite is formed in the surface layer of the sintered compact 1'(in particular, in a high-carbon region in the vicinity of the surface). After that, the sintered compact 1' is subjected to tempering treatment to be imparted with toughness.

(4) Grinding Step

The sintered compact having been subjected to the carburizing and quenching treatment has low dimensional accuracy owing to a thermal strain. When the sintered compact is subjected to grinding work, a sliding surface having high dimensional accuracy is formed.

(5) Nitriding Step

The sintered compact after the grinding step is subjected to nitriding treatment. In this embodiment, the sintered compact is subjected to salt-bath nitrocarburizing treatment. Specifically, the sintered compact is heated to a predetermined temperature (e.g., from 500° C. to 620° C.) under a state in which the sintered compact is immersed in a nitrocarburizing salt bath, and thus a nitrided layer is formed on the surface of the sintered compact. The nitrocarburizing salt bath mainly contains a cyanide salt, such as sodium cyanate (NaCNO) or potassium cyanate (KCNO), and nitriding proceeds through a reaction between nitrogen in the salt bath and iron. In this embodiment, the carbon diffusion layer 20 formed in the surface layer of the sintered compact is subjected to a reaction with nitrogen in the salt bath, and thus the compound layer 11 which is formed of an iron and steel nitride and has an ultra-high hardness is formed on the surface of the sintered compact. At the same time, nitrogen in the salt bath penetrates and diffuses into the carbon diffusion layer 20, and thus the diffusion layer 12 is formed under the compound layer 11 (see FIG. 1). As described above, the diffusion layer 12 having a high hardness and high strength can foe formed by forming the carbon diffusion layer 20 having a high concentration of carbon in the surface layer of the sintered compact 1' through the carburizing treatment, and then allowing nitrogen to penetrate and diffuse into the carbon diffusion layer 20 through the nitriding treatment. Under the diffusion layer 12, nitrogen in the salt bath hardly penetrates and diffuses, and thus the gradient region 13*a* of the base material layer 13 having almost the same composition as the carbon diffusion layer 20 is formed.

In this embodiment, the sintered compact has a high density (7.0 g/cm$^3$ or more), and hence a nitriding treatment liquid penetrates into only the surface layer of the sintered compact, and hardly penetrates into an inside of the sintered compact. With this, an inconvenience in which the treatment liquid cannot be discharged from inner pores of the sintered compact after the nitriding treatment can be avoided.

As described above, the density of the sliding member 1 of this embodiment can be increased through use of the low-chromium steel powder. In addition, the sliding surface 1*a* having an ultra-high hardness is formed by subjecting the sintered compact to the nitriding treatment to form the compound layer 11. Further, the diffusion layer 12 having high strength is formed by subjecting the sintered compact to the carburizing treatment, followed by the nitriding treatment. When the density, hardness, and strength of the sintered compact are increased as described above, the sliding member 1 having extremely excellent wear resistance can be obtained.

The present invention is not limited to the above-mentioned embodiment. in the above-mentioned embodiment, the case in which the salt-bath nitrocarburizing treatment is performed in the nitriding step is presented as an example, but the present invention is not limited thereto. For example, it is also appropriate to perform gas nitrocarburizing treatment. However, it is preferred to perform the salt-bath nitrocarburizing treatment because the compound layer 11 formed through the salt-bath nitrocarburizing treatment has a uniform thickness and has a smooth surface as compared to a compound layer formed through the gas nitrocarburizing treatment.

In addition, in the above-mentioned embodiment, the carburizing and quenching step is performed after the sintering step, but these steps maybe performed at the same time in one device. For example, it is appropriate to sinter the green compact in an atmosphere containing carbon (e.g., a natural gas or an endothermic gas (RX gas)) to form the sintered compact and allow carbon to penetrate and diffuse into the surface layer of the sintered compact at the same time.

In addition, in the sintering step, the green compact may be brought into contact with a heatsink having a high thermal conductivity in advance and sintered under such state to form the sintered compact. In this case, after the sintering, the sintered compact is rapidly cooled when heat of the sintered compact is released through the heat sink. The heat sink is preferably formed of a material having a thermal conductivity of from 100 $W \cdot m^{-1} \cdot K^{-1}$ to 10,000 $W \cdot m^{-1} \cdot K^{-1}$. A nitrogen gas may be sprayed on the sintered compact while the sintered compact is cooled.

In addition, the case in which, the sliding member according to the present invention is applied to the swash plate 103 of the swash plate-type air compressor is presented in the above-mentioned embodiment, but the present invention is not limited thereto. For example, the sliding member according to the present invention is also applicable to the shoe 107 of the swash plate-type air compressor (see FIG. 6), a bearing, a cam, or the like.

REFERENCE SINGS LIST

1 sliding member
1*a* sliding surface
11 compound layer
12 diffusion layer
13 base material layer
20 carbon diffusion layer
102 rotary shaft
103 swash plate
104 piston
107 shoe

The invention claimed is:

1. A sliding member, comprising an iron and steel-based sintered compact containing chromium, molybdenum, and carbon and having a content of chromium of 5 mass % or less, wherein the sintered compact comprises:

a compound layer which has a sliding surface and is formed mainly of an iron and steel nitride; and a diffusion layer which is adjacent to the compound layer and has an iron and steel structure into which nitrogen and carbon diffuse, wherein concentrations of carbon and nitrogen in the diffusion layer of the sintered compact are gradually reduced with increasing depth from the sliding surface, wherein a hardness of the compound layer is from 850 HV to 1,000 HV, and wherein the sintered compact has a relative density of 90% or more.

2. The sliding member according to claim 1, wherein a concentration of carbon at an interface between the compound layer and the diffusion layer is 0.6 mass % or more.

3. A sliding member, comprising an iron and steel-based sintered compact containing chromium, molybdenum, and carbon and having a content of chromium of 5 mass % or less, wherein the sintered compact comprises:

a compound layer which has a sliding surface and is formed mainly of an iron and steel nitride; and a diffusion layer which is adjacent to the compound layer and has an iron and steel structure into which nitrogen and carbon diffuse, wherein a hardness of the sintered compact is gradually reduced with increasing depth from the sliding surface, wherein a curve representing the hardness of the sintered compact as a function of a depth from the sliding surface has, in a region in a depth direction of the diffusion layer, a region having a lower gradient than regions on both sides thereof in the depth direction, wherein a hardness of the compound layer is from 850 HV to 1,000 HV, and wherein the sintered compact has a relative density of 90% or more.

4. A production method for a sliding member, comprising the steps of:

forming a green compact through use of raw material powder containing chromium-molybdenum-based alloy steel powder having a content of chromium of 5 mass % or less and carbon powder;

sintering the green compact to provide a sintered compact;

subjecting the sintered compact to carburizing treatment to allow carbon to penetrate and diffuse into a surface layer of the sintered compact, followed by subjecting the sintered compact to quenching; and subjecting the sintered compact to nitriding treatment to allow nitrogen to penetrate and diffuse into the surface layer of the sintered compact so as to form a compound layer which has a sliding surface and is formed mainly of an iron and steel nitride, in the stated order, wherein a hardness of the compound layer is from 850 HV to 1,000 HV, and wherein the sintered compact has a relative density of 90% or more.

5. The production method for a sliding member according to claim 4, wherein the nitriding treatment comprises salt-bath nitrocarburizing treatment.

6. The production method for a sliding member according to claim 4, further comprising, before the subjecting the sintered compact to nitriding treatment, subjecting the sintered compact to grinding work to form a sliding surface.

7. A production method for a sliding member, comprising the steps of:

forming a green compact through use of raw material powder containing chromium-molybdenum-based alloy steel powder having a content of chromium of 5 mass % or less and carbon powder;

sintering the green compact to provide a sintered compact, and at the same time, subjecting the sintered compact to carburizing treatment to allow carbon to penetrate and diffuse into a surface layer of the sintered compact, followed by subjecting the sintered compact to quenching; and subjecting the sintered compact to nitriding treatment to allow nitrogen to penetrate and diffuse into the surface layer of the sintered compact so as to form a compound layer which has a sliding surface and is formed mainly of an iron and steel nitride, in the stated order, wherein a hardness of the compound layer is from 850 HV to 1,000 HV, and wherein the sintered compact has a relative density of 90% or more.

* * * * *